US006409966B1

(12) United States Patent
Sircar

(10) Patent No.: US 6,409,966 B1
(45) Date of Patent: Jun. 25, 2002

(54) FREE MACHINING ALUMINUM ALLOY CONTAINING BISMUTH OR BISMUTH-TIN FOR FREE MACHINING AND A METHOD OF USE

(75) Inventor: Subhasish Sircar, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 09/576,813

(22) Filed: May 23, 2000

Related U.S. Application Data

(63) Continuation-in-part of application No. 08/081,452, filed on May 19, 1998, now Pat. No. 6,065,534.
(60) Provisional application No. 60/144,255, filed on Jul. 19, 1999.

(51) Int. Cl.[7] ..... C22C 21/00
(52) U.S. Cl. ..... 420/530; 420/536; 420/554
(58) Field of Search ..... 420/530, 536, 420/554

(56) References Cited

U.S. PATENT DOCUMENTS

| | | | | |
|---|---|---|---|---|
| 3,753,695 A | | 8/1973 | Lloyd | |
| 3,925,067 A | * | 12/1975 | Sperry et al. | 75/142 |
| 4,005,243 A | | 1/1977 | Baba et al. | |
| 4,244,756 A | | 1/1981 | Tanabe et al. | |
| 4,471,032 A | | 9/1984 | Fukuoka et al. | |
| 4,590,133 A | | 5/1986 | Lloyd | |
| 4,617,172 A | | 10/1986 | Mori | |
| 4,747,889 A | | 5/1988 | Nishio et al. | |
| 4,957,822 A | | 9/1990 | Steeg et al. | |
| 5,122,208 A | | 6/1992 | Alabi | |
| 5,282,909 A | | 2/1994 | Ara et al. | |
| 5,286,445 A | | 2/1994 | Kamiya | |
| 5,375,760 A | | 12/1994 | Doko | |
| 5,511,603 A | | 4/1996 | Brown et al. | |
| 5,522,950 A | | 6/1996 | Bartges et al. | |
| 5,525,294 A | | 6/1996 | Tanaka et al. | |
| 5,573,608 A | | 11/1996 | Miyake et al. | |
| 5,580,402 A | | 12/1996 | Fujita et al. | |
| 5,587,029 A | | 12/1996 | Sircar | |
| 5,593,082 A | | 1/1997 | Ivanov et al. | |
| 5,725,694 A | | 3/1998 | Sircar | |
| 5,744,255 A | | 4/1998 | Doko et al. | |
| 5,771,965 A | | 6/1998 | Inaba et al. | |
| 5,776,269 A | * | 7/1998 | Farrar, Jr. et al. | 148/689 |
| 5,803,994 A | * | 9/1998 | Coats, II et al. | 148/416 |
| 6,113,850 A | * | 9/2000 | Bartges et al. | 420/520 |

FOREIGN PATENT DOCUMENTS

| | | | |
|---|---|---|---|
| JP | 57-149443 A | * | 9/1982 |
| JP | 58-117850 A | * | 7/1983 |
| JP | 09-025533 A | * | 1/1997 |

OTHER PUBLICATIONS

Cayless, R.B.C. (1990), ASM Handbook: Volume 2 Properties and Selection: Nonferrous Alloys and Special–Purpose Materials, "Alloy and Temper Designation Systems for Aluminum and Aluminum Alloys", pp. 15–21.*

Spillard, Ultralloy® 6020: A Lead Free Aluminum Alloy featuring "A" Rated Machinability, publisication, pp. 61–68.

* cited by examiner

*Primary Examiner*—George Wyszomierski
*Assistant Examiner*—Janelle Combs-Morillo
(74) *Attorney, Agent, or Firm*—David Pearce-Smith; Christopher W. Brody

(57) ABSTRACT

One free machining aluminum alloy includes bismuth as a free machining elemental constituent that functions as a discontinuity in the aluminum alloy matrix rather than a low melting point compound. Using bismuth in weight percents of the total composition ranging between 0.1% and 3.0% improves both machinability and mechanical properties. The bismuth can act as a substitute for another free machining constituent in a free machining aluminum alloy or can be added to an aluminum alloy to improve its machinability. Another free machining aluminum alloy has bismuth and tin as free machining constituents for improved machining. When using bismuth and tin, the bismuth ranges between 0.1 and 3.0% by weight and the tin ranges between 0.1 and 1.5% by weight.

14 Claims, No Drawings

FREE MACHINING ALUMINUM ALLOY CONTAINING BISMUTH OR BISMUTH-TIN FOR FREE MACHINING AND A METHOD OF USE

This application is a continuation-in-part of patent application Ser. No. 08/081,452, filed on May 19, 1998 now U.S. Pat. No. 6,065,534, herein incorporated in its entirety by reference, and priority is claimed under 35 U.S.C. § 120, and priority is claimed under 35 U.S.C. § 119(e) based on Ser. No. 60/144,255, filed on Jul. 19, 1999.

FIELD OF THE INVENTION

The present invention is directed to a free machining aluminum alloy containing bismuth as a free machining constituent thereo, or bismuth and tin as machining constituents and a method of use and, in particular, to a free machining aluminum alloy containing bismuth as a low melting point elemental discontinuity or bismuth and tin, each of which provides improved machining without loss of mechanical properties.

BACKGROUND ART

Free machining aluminum alloys are well known in the art. These alloys typically include free machining compounds such as lead-tin, indium-bismuth, and tin for improved machinability. In many of these alloys, these elements form low melting point compounds which readily melt or soften due to the friction heat created during machining. More specifically, at the point of contact between the machining tool and the material, softening and melting occurs. As a result of these changes, breakage occurs, chips are formed and material removal is enhanced.

When using free machining constituents having higher melting points than the eutectic-types noted above, material removal results from a different mechanism. At the point of contact with the machining tool, void formation occurs as a result of the different flow characteristics between the base aluminum and the high melting point constituent. This void formation then causes breakage and subsequent chip formation. Formation of the chips equates to material removal.

When using low melting point constituents, the flow characteristics of the constituents is similar to that of the aluminum base material. Consequently, void formation as a mechanism for material removal does not appear to be a plausible advantage.

One example of a free machining alloy is disclosed in U.S. Pat. No. 5,522,950 to Bartges et al. This patent discloses a substantially lead-free AA6XXX aluminum alloy which is substantially free of lead, bismuth, nickel, zirconium and cadmium. The free machining element in the Bartges et al. patent is tin only in amounts between about 1.01% and 1.5% by weight. In this patent, the tin could have a beneficial effect on material removal both from the standpoint of void formation, and as a relatively low melting point constituent (as compared to high melting point constituents) with respect to the aluminum base.

While the Bartges et al. patent provides improvements in free machining alloys by limiting the levels of lead and bismuth, the presence of tin adversely effects the alloys' mechanical properties, particularly impact properties. In other words, adding tin only makes this alloy brittle and renders it unacceptable where impact properties in a particular application may be important.

Another drawback associated with free machining alloys containing tin is a lack of corrosion resistance in environments where hot brake fluid is present. Brake system components made from tin-containing free machining alloys exhibit excessive corrosion in the presence of brake fluid.

In light of the deficiencies described above for tin-containing free machining aluminum alloys, a need has developed to provide an improved free machining aluminum alloy which overcomes the prior art deficiencies now in existence.

In response to this need, the present invention, in one embodiment, provides a free machining aluminum alloy that utilizes effective amounts of bismuth as a free machining elemental constituent. In another embodiment, the aluminum alloy has effective amounts of bismuth and tin to greatly improve machinability.

Bismuth-containing aluminum alloys have been proposed as bearing materials as disclosed in U.S. Pat. No. 5,286,445 to Soji. Bismuth is added to these alloys to enhance self lubricity and these alloys are not generally used or adaptable as free machining alloys.

Machinability improvement via bismuth addition is achieved by either softening of the bismuth particles during local temperature rise during machining or by void formation due to deformation mismatch between bismuth and the aluminum matrix during machining. It is also possible that a combination of the two processes is at play during machining which gives rise to improvement in machinability.

SUMMARY OF THE INVENTION

Accordingly, it is a first object of the present invention to provide an improved free machining aluminum alloy.

Another object of the present invention is to provide an aluminum alloy having free machining constituents which do not deleteriously affect mechanical properties, particularly impact properties.

A still further object of the present invention is to provide a method of machining aluminum alloy articles using a bismuth-containing or bismuth and tin-containing aluminum alloy.

One other object of the present invention is to provide machined aluminum alloy products from the inventive methods.

Yet another object of the invention is the use of bismuth or bismuth and tin as a substitute free machining element or elements for other free machining constituents in free machining aluminum alloys.

Other objects and advantages of the present invention will become apparent as a description thereof proceeds.

In satisfaction of the foregoing objects and advantages, the present invention is an improvement over prior art free machining aluminum alloys. In contrast to existing free machining aluminum alloys, in one embodiment, the inventive alloy utilizes bismuth as a low melting point free machining elemental constituent. The bismuth is controlled so that it occupies between about 0.1% and about 3.0% by weight of the total composition.

When using bismuth alone, the bismuth is preferably uniformly dispersed throughout the alloy so that effective machining is achieved regardless of the orientation between a workpiece made of the inventive alloy and a machining tool.

In another embodiment, bismuth and tin are employed together as free machining constituents so as to total together the levels described for bismuth alone. When using these elements together, the amount of bismuth ranges between 0.1% and about 3.0% by weight, and the amount of tin ranges between about 0.1 and 1.5% by weight.

The free machining elemental constituents are believed to be applicable to aluminum alloys such as the AA1000 series, AA2000 series, AA3000 series, AA4000 series, AA5000 series, AA6000 series, and AA7000 series. More preferred classes of alloys include the AA2000, AA4000, and AA6000 series aluminum alloys.

More preferred weight percents for bismuth alone range between about 0.1% and 1.5%, between about 0.1% and 1.0% and between about 0.2% and 0.8%, respectively. More preferred weight percentage ranges for each of bismuth and tin when used together comprise between 0.1 and 1.3%, between 0.1 and 1.0%, and between 0.1 and 0.85%.

The invention also includes a machining process whereby an aluminum alloy article made from the inventive free machining alloy composition is machined to a desired shape. The invention also encompasses the machined article made by the inventive method.

Another aspect of the invention details a method of improving the impact properties of free machining aluminum alloys by providing a molten AA6000 series aluminum alloy and adjusting its composition by adding an amount of bismuth or bismuth and tin so that the final alloy composition has between about 0.1% and 3.0% by weight of the total of the added amount when bismuth alone is used and between 0.1 and 3.0% by weight of bismuth and between 0.1 and 1.5% by weight of tin, when combined together. The solidified alloy can then be subjected to machining with the machined article having no deleterious effects on mechanical properties, especially impact properties.

DESCRIPTION OF THE PREFERRED EMBODIMENTS

In one mode of the invention, using bismuth as an insoluble low melting point free machining element in an aluminum alloy material, enhanced machining is obtained. While the exact mechanism is not known as to why bismuth enhances machinability, it is clear that the presence of bismuth in a given aluminum alloy greatly enhances its machinability, and at the same time, does not compromise the alloy's mechanical properties.

The cause or mechanism that provides the enhanced machining could be: (1) an effect related to void formation due to non-uniform deformation of bismuth and the aluminum matrix during the machining process; (2) an effect related to bismuth being a low melting point constituent as compared to the base aluminum; (3) a combination of both.

Referring to effect (1), since bismuth is elemental and is not in the form of a low melting point or eutectic compound, it can remain as a discontinuity in the aluminum alloy matrix. Consequently, when the matrix material is being subjected to machining forces, the bismuth will tend to shear differently with respect to its surrounding aluminum alloy matrix, thereby creating voids therebetween. Continued application of the machining forces creates new voids and propagates existing voids until the voids interconnect and machining debris is formed.

Alternatively, since bismuth's melting point is 271° C. and the base aluminum's melting point is 660°, bismuth may also act as a low melting point constituent during machining, wherein the bismuth may soften and/or melt as a precursor to breakage, chip formation, and material removal. During machining, a combination of the effects may also occur to enhance machining.

Besides improving machinability, bismuth does not have any deleterious effects to the alloy's mechanical properties over those prior art alloys containing insoluble elements such as the tin-containing AA6020. As more fully described below, alloys containing bismuth as a free machining elemental constituent does not exhibit the brittleness that is found in tin only containing aluminum alloys.

Another significant advantage of using bismuth as a free machining constituent over tin is the elimination of the corrosive effects of brake fluid on tin-containing free machining alloys. Bismuth-containing alloys without tin do not suffer from the corrosive effects of hot brake fluid and can be used in brake components without fear of premature failure in this regard.

The amount of bismuth that can be effective as a free machining elemental constituent is measured in terms of weight percent. An effective amount is believed to range between about 0.1% and 3.0% by weight with more narrow ranges within these outer limits exemplifying more preferred embodiments of the invention. Other weight percent ranges include between about 0.1% and 1.5%, between about 0.1% and 1.0%, between about 0.2% and 0.8%, and even a target of between about 0.3% and 1.2%. The bismuth should be uniformly dispersed throughout the matrix so that effective machining occurs regardless of where the tool contacts the article being machined.

As described above, aluminum alloys of the series AA1000, AA2000, AA3000, AA4000, AA5000, AA6000 and AA7000, are believed to be candidates for using bismuth as a free machining elemental constituent. More preferred series include the AA2000, AA4000, and AA6000. Preferred alloys within the AA6000 series aluminum alloys include AA6061, AA6070, and AA6082, as well as alloys similar thereto. The classes of aluminum alloys are those which would be adaptable for a machining operation but do not exhibit superb machining properties, i.e., are still in need of improved machinability. Alloys which would not be susceptible to machining or considered to be even remotely machinable by those of ordinary skill in the art are not intended to fall under the classes of alloys exemplified above.

AA6061 alloys comprises 0.4 to 0.8% silicon, up to 0.7% iron, 0.15–0.40% copper, up to 0.15% Mn, 0.8 to 1.2% Mg, 0.04 to 0.35% chromium, up to 0.25% Zn, up to 0.15% titanium, with the balance aluminum and inevitable impurities.

Another composition suitable for machining from the AA6000 series alloys includes, in weight percent, between about 0.70 to 1.7% silicon, up to 0.50% iron, up to 0.40% copper, between about 0.40 and 1.0% manganese, between about 0.50 and 1.2% magnesium, up to 0.25% chromium, up to 0.25% zinc, up to 0.15% titanium, up to 0.20% zirconium, the balance being incidental impurities and aluminum. A more preferred composition has ranges including between about 0.70 and 1.3% silicon, up to 0.10% copper, between about 0.50 and 1.2% manganese, up to 0.20% zinc, and up to 0.10% titanium.

Yet another preferred composition contains between about 1.0 and 1.7% silicon, up to 0.10% chromium, and between about 0.15 and 0.40% copper, 0.40 and 1.0% manganese, between about 0.50 and 1.2% magnesium, up to 0.10% chromium, up to 0.25% zinc, up to 0.15% titanium, up to 0.20% zirconium, the balance being incidental impurities and aluminum.

When using an AA4000 series alloy, exemplary ranges in weight percent for silicon, iron, copper, manganese, magnesium, zinc, and titanium include: between about 3.5 to 7.5% Si, up to about 1.0% Fe, up to about 0.5% Cu, up to about 0.4% Mn, between about 0.2 to 1.0% Mg, up to 0.2%

Zn, and up to about 0.2% Ti, with the normal incidental impurities associated with these types of alloys.

The bismuth addition as a free machining elemental constituent can also be a substitute for one or more free machining constituents in a free machining aluminum alloy. In this embodiment, free machining aluminum alloys are considered to be those base alloy compositions which are recognized in the art as free machining alloys, e.g., AA6020, AA6030, AA2111, AA2012 or the like. In this embodiment, the bismuth acts as a substitute for the prior art free machining constituents, e.g., lead-tin or bismuth-lead compounds.

While bismuth alone has been disclosed as a free machining addition, bismuth and tin can be combined as free machining constituents for any of the alloy systems disclosed herein. When bismuth and tin are employed together, the weight ranges based on the total alloy weight are between about 0.1 and 3.0% for bismuth and between about 0.1 and 1.5% tin. More preferred weight percentage ranges for each of bismuth and tin when used together comprise between 0.1 and 1.3%, between 0.1 and 1.0%, and between 0.1 and 0.85%. Even more preferred ranges for bismuth and tin include between about 0.2 and 1.0% bismuth and between about 0.2 and 0.8% tin. Other preferred ranges include between about 0.3 and 1.0% bismuth and between about 0.3 and 0.7% tin.

It is also believed that minimum levels of zinc, e.g., less than 0.03% by weight, can be used with the bismuth addition for effective machining. Alternatively, zinc levels as high as about 0.8% by weight does not adversely affect the bismuth-driven free machining characteristics.

While the size of the bismuth constituent in the aluminum alloy matrix can vary, a sufficiently fine distribution is preferred so that free machining occurs throughout the workpiece. A preferred range of the bismuth constituent size is up to about 10 microns, more preferably up to about 5 microns. The constituent size is preferably viewed transverse to the working direction of the workpiece to be machined.

Trials were conducted in order to more fully demonstrate the unexpected results associated with the inventive alloy and its method of use. The trials described below are intended to illustrate the inventive alloy, the inventive method and products therefrom but are not considered to be limiting to their scope.

In order to demonstrate the machinability of the inventive alloy composition, in one mode, an AA6061 alloy was modified with various additions of zinc and bismuth. Five alloys designated as A–E employed increasing levels of zinc alone. Five more alloys designated as alloys F–J combined two different levels of zinc with varying levels of bismuth. Finally, another alloy K combined bismuth with a low level of zinc. Alloys L and M also simulate modified AA6061 alloys. The compositions of alloys A–M are shown in Table I relating to the modified AA6061 alloy.

At the same time, other aluminum compositions were modified with bismuth and bismuth/tin additions to investigate the effects of such modifications on machining behavior. Alloys O and P of Table I generally follow AA3000 series compositional ranges, more particularly AA3003 alloys that contain effective levels of manganese but little magnesium or low levels thereof.

Alloys Q and R of Table I are similar to AA6070 alloys modified with either bismuth alone or bismuth and tin.

TABLE I*

| ALLOY | Si | Fe | Cu | Mn | Mg | Cr | Ni | Zn | Ti | Bi | Sn |
|---|---|---|---|---|---|---|---|---|---|---|---|
| A | .57 | .25 | .25 | .01 | .91 | .10 | <.01 | .02 | .02 | — | |
| B | .58 | .25 | .25 | .01 | .88 | .10 | <.01 | .10 | .02 | — | |
| C | .62 | .28 | .25 | .01 | .89 | .11 | <.01 | .20 | .02 | — | |
| D | .60 | .26 | .25 | .01 | .88 | .10 | <.01 | .38 | .02 | — | |
| E | .62 | .26 | .25 | .01 | .94 | .10 | <.01 | .75 | .02 | — | |
| F | .58 | .25 | .24 | .01 | .92 | .10 | <.01 | .40 | .02 | .12 | |
| G | .57 | .24 | .24 | .01 | .90 | .10 | <.01 | .78 | .02 | .12 | |
| H | .59 | .25 | .24 | .01 | .89 | .10 | <.01 | .41 | .02 | 1.39 | |
| I | .57 | .25 | .24 | .01 | .96 | .10 | <.01 | .79 | .02 | 1.39 | |
| J | .58 | .27 | .25 | .01 | .95 | .12 | <.01 | .40 | .02 | .72 | |
| K | .60 | .27 | .24 | .014 | .91 | .10 | .002 | .028 | .019 | 1.19 | |
| L | .64 | .20 | .20 | .02 | .90 | .07 | <.01 | .02 | .015 | 1.4 | |
| M | .64 | .20 | .20 | .02 | .90 | .07 | <.01 | .4 | .015 | 1.4 | |
| N | .07 | .03 | .28 | 1.5 | <.01 | <.02 | <.01 | .02 | .16 | 1 | |
| O | .20 | .65 | .30 | 1.5 | .4 | .2 | <.01 | .4 | .16 | 1.4 | |
| P | .20 | .65 | .30 | 1.5 | .1 | .2 | <.01 | .03 | .04 | .7 | .5 |
| Q | 1.3 | .2 | .28 | .7 | .75 | .07 | <.01 | .02 | — | 1.4 | |
| R | 1.3 | .2 | .28 | .7 | .75 | .07 | <.01 | .02 | — | .7 | .5 |

*Values in weight percent.

Table II shows average values of tensile strength, yield strength and elongation for the alloys A–K of Table I. The tensile specimens were ¼ inch (6.25 mm) in diameter and the material was in the as-extruded condition when tested. As is evident from Table II, the addition of bismuth as a free machining constituent in alloys F–K does not adversely affect the mechanical properties. That is, elongation remains in the 16% to 18% range, this being essentially the same range as for alloys A–E without bismuth. Table II shows that mechanical properties are also generally unaffected when using bismuth alone as a free machining element.

TABLE II

| Alloy | Tensile Strength (ksi)* | Yield Strength (ksi)* | Elongation % |
|---|---|---|---|
| A | 42.5 | 38.4 | 18.0 |
| B | 38.5 | 33.4 | 19.0 |
| C | 46.9 | 43.6 | 17.0 |
| D | 41.3 | 37.0 | 17.5 |
| E | 44.1 | 40.3 | 17.5 |
| F | 41.9 | 37.2 | 18.0 |

TABLE II-continued

| Alloy | Tensile Strength (ksi)* | Yield Strength (ksi)* | Elongation % |
|---|---|---|---|
| G | 40.1 | 36.1 | 18.0 |
| H | 43.3 | 40.0 | 19.0 |
| I | 42.4 | 38.7 | 18.0 |
| J | 41.7 | 37.7 | 16.5 |
| K | 50.7 | 48.0 | 17.5 |

*ksi/1.422 = kg/mm$^2$

The eighteen alloys detailed in Table I were subject to machinability studies. The eighteen alloys were machined along with standard AA6061-T6511, AA6063, and AA6082 alloys for comparison purposes. For the machinability test, an engine lathe was used, the lathe set up to run at 2000 rpm at 0.197 inches (5 mm) per minute feed rate. This setup removed 0.100 inches (2.54 mm) from the diameter of 1 inch diameter (25.4 mm) sample pieces. A carbide insert was used as a machining tool and the tool chip breaker was moved back from the cutting edge to prevent the chips from contacting it. No coolant was used as part of the test work. Each part was checked immediately before and after the cut for surface temperatures with a hand-held thermocouple and reader. Chips from each cut were collected for later study and the cut was set for a 6 inch length (152.4 mm) around the 1 inch (25.4 mm) diameter round. Visual data and observations were taken during and immediately after the cut. The test results are shown in Table III.

TABLE III

TURNING OPERATION TO QUALIFY AND QUANTIFY MACHINABILITY OF 1" DIAMETER ROD

| | Part Surface Temperature-Deg. F. | | PART SURFACE | CHIP | | EDGE BUILDUP | EASE OF CUT NOISY, QUIET | OVERALL RATING |
|---|---|---|---|---|---|---|---|---|
| ALLOY | BEFORE | AFTER | FINISH | SIZE | SHAPE | ON TOOL | CHATTER, SQUEEL | (−10 TO +10) |
| A | 73.4 | 99.7 | Ragged, rough finish | Long, heavy | Long curls, compacted | Heavy BUE on insert | Rough, tearing, ragged cut with some burr on shoulder | −3 |
| B | 73.3 | 103.7 | Ragged, stepped | Long strings and curls | Strings and curls; compacted | Heavy BUE; chip stuck to insert | Noisy, rough, tearing cut with large ragged burr on shoulder | −4 |
| C | 73.5 | 105.3 | Ragged and stepped | Long strings; some long curls | Strings and curls; chips compacted | Minor BUE | Rough, tearing cut; ragged burr on shoulder | −2 |
| D | 74.1 | 102.8 | Rough with some steps in surface | Long strings | Compacted strings | Heavy BUE on insert | Noisy, rough cut; some burr on shoulder | −1 |
| E | 74.3 | 100.7 | Rough | Long strings with some curls | Strings, curls | Some BUE on insert | Rough cut; no burr on shoulder | −½ |
| F | 75.2 | 105.6 | Ragged | Long curls | Curls | Slight BUE | Small burr on shoulder | −½ |
| G | 74.4 | 108.7 | Ragged | Long strings | Strings | Large BUE | Somewhat noisy; burr on shoulder | −4 |
| H | 74.3 | 86.2 | Somewhat rough finish | Med. Curls | Curls | No BUE | Somewhat noisy | 2 |
| I | 74.4 | 86.2 | Rough finish | Medium strings and curls | Strings and curls | No BUE | Noisy cut; (not quite as good as H) | 2 |
| J | 73.8 | 89.3 | Some chatter | Small to medium curls | Curls | No BUE | Some burr on shoulder | 1 |
| K | 74.2 | 85.2 | Not a smooth finish, but OK | Small curls @ start, medium strings @ end | Curls and strings | No BUE | OK cut | 3 |
| L | 74 | 81 | Smooth-Bright Finish | Curls-Tom Edges on Chips | | None | Quiet-Smooth-Bright Finish- Some Milks Spots | 5 |
| M | 74 | 81 | Smooth-Bright Minor Spotting | Curls | 1" to 2" Long | None | Quite-Smooth Curls | 6 |
| N | 75 | 89 | Milky Color-Smooth | Curls | Small-Short (one to two curls) | Minimal | Smooth-Chopped OK | 3 |
| O | 74 | 83 | Milky Color-Minor Tearing in Surface | Med. Curls 1" to 2" Long | | Minimal | Good Cut | 4 |
| P | 74 | 82 | Milky Color-Smooth Cut | Small Dia. | Single Curls | Minimal | Good Cut-Quiet | 5 |
| Q | 74 | 81 | Smooth Surface | Curls | 1" to 2" Long | None | Smooth-Bright Finish - Quiet | 6 |
| R | 74 | 81 | Smooth-Bright | Curls | 2" to 6" | None | Smooth-Bright Surfaces- | 4 |

TABLE III-continued

TURNING OPERATION TO QUALIFY AND QUANTIFY MACHINABILITY OF 1" DIAMETER ROD

| | Part Surface Temperature-Deg. F. | | PART SURFACE | CHIP | | EDGE BUILDUP | EASE OF CUT NOISY, QUIET | OVERALL RATING |
|---|---|---|---|---|---|---|---|---|
| ALLOY | BEFORE | AFTER | FINISH | SIZE | SHAPE | ON TOOL | CHATTER, SQUEEL | (−10 TO +10) |
| 6061 | 74.4 | 102.7 | No Tearing Rough/noisy cut with a sandy finish | Long chips with some strings | Long Compacted chips and strings | Minor BUE on insert | Quiet Noisy, rough cut; no burr on shoulder | 0 |
| 6063 | 74 | 95 | Torn | Long | Long Strings Thickened | None | Noisy-Tearing Metal-Surface Rough | 0 |
| 6082 | 74 | 94 | Tearing | Long, continuous-very hot | | None | Very Noisy-Rough, Torn, Surfaces-Large Burn at end of cut | −1 |

The cut using the AA6061-T6511 alloy was used a baseline and given an arbitrary rating of 0 on a scale of −10 to +10. Machining the AA6061 alloy produced long curls with curls that were somewhat compacted or thickened. A significant increase in temperature was noted before and after the test.

As can be seen from Table III, significant machining improvement is realized when adding bismuth as the free machining element, or when both bismuth and tin are used. Particularly improved results are shown for alloys H, I, and K–R. Alloys P and R show improvements when bismuth and tin are used. Alloys H, I, K–N, and Q show improvement when bismuth alone is used.

The machining studies demonstrate that significant improvements are realized when AA3000 series alloys are modified and an AA6070 type alloy is modified. This improvement is more noticeable when the ratings for other known alloys, e.g., AA6063 and AA6082 are compared to the bismuth and bismuth-tin modified alloys.

The improved results associated with alloy K demonstrate that zinc is not an essential element for improved machinability. Alloys being essentially zinc free or having low levels of zinc, e.g., less than about 0.03% by weight, still exhibit acceptable machining characteristics.

The bismuth-containing free machining elements also have improved impact properties over those containing tin as the free machining constituent. Testwork shows that the exemplified free machining aluminum alloy composition is vastly superior to an AA6020 aluminum alloy which corresponds to the alloy disclosed in the Bartges et al. patent discussed above. The exemplified bismuth-containing free machining aluminum alloy has significantly improved impact properties, such improvement unexpected in light of the fact that each of bismuth and tin is essentially insoluble in aluminum. The impact property improvement can be attained by first forming the alloy composition with bismuth as a part thereof into an article or workpiece and then either machining the article or processing the article into another shape or condition, e.g., working with or without heat treatment, and then machining.

The machining study for alloys L–R also shows that significant improvement is seen in machining for alloys having compositional ranges differing dramatically from Alloys A–K. More specifically, Alloys L and M exhibit ratings of 5 and 6. Alloys P and Q have similar ratings, with Alloy Q having curl sizes of only 1–2 inches.

The inventive alloys also permit increased productivity during machining. Since the inventive alloys machine so well, machining speed are increased, tool replacement frequency is lowered, and operation downtime due to the interference of machining debris with the machine operation is minimized.

The inventive alloy can be formed into a workpiece using conventional techniques such as casting, homogenizing, hot and cold working, heat treating and the like. The bismuth or bismuth and tin are preferably added to a molten aluminum alloy to obtain the desired weight percentages.

In terms of weight percent, in one embodiment, the alloy modified with bismuth or bismuth and tin can have bismuth range from about 0.1% up to about 3.0% by weight, with more narrow ranges in weight percent of about 0.2% to 2.5%, about 0.3 to 2.25%, and about 0.3 to 2.0%.

The tin amount when combined with bismuth can be up to about 1.5% by weight. More preferred values of tin in weight percent are between 0.1 and 1.0%, more preferably between 0.2 and 0.8%.

A preferred article for machining is an anti-lock braking system (ABS) housing. These housings are generally manufactured from AA6000 series alloys and contain numerous orifices and chambers to facilitate operation of the braking system. Consequently, the machining demands are high. Making these housings from the inventive alloys in an AA6000 grade material offers significant improvements in the time in which these housings can be machined. It is preferred that these components as well as others that come in to contact with brake fluid utilize the bismuth-only version of the invention since tin is generally considered to be an undesirable alloying element when brake fluid is present.

Any types of machining operations can be employed with the inventive alloy. Machining operations can be combined with other operations as well. The article or workpiece to be machined can have any configuration and the machined article can be subjected to post machining operations as would be within the skill of the art.

As such, an invention has been disclosed in terms of preferred embodiments thereof which fulfill each and every one of the objects of the present invention as set forth above and provides a new and improved free machining aluminum alloy and a method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a free machining aluminum alloy having a free machining constituent as a part thereof, the improvement comprising employing bismuth as a sole free machining constituent in an AA6000 series aluminum alloy, the amount of bismuth between about 0.1 and 1.7% by weight.

2. The improvement of claim 1, wherein the aluminum alloy is one of an AA6061 alloy, an AA6070 alloy, and an AA6082 alloy.

3. The improvement of claim 1, wherein the bismuth weight percent ranges between about 0.2% and 1.5%.

4. The improvement of claim 1, wherein the aluminum alloy is essentially zinc-free.

5. An article having the composition of claim 1.

6. In a free machining aluminum alloy having a free machining constituent as a part thereof, the improvement comprising employing bismuth as a sole free machining constituent, the amount of bismuth between about 0.1 and 1.7% by weight, and wherein the aluminum alloy is selected from the group consisting of AA1000 series, AA5000 series, and AA7000 series aluminum alloys.

7. In a method of machining an aluminum alloy article made of a free machining aluminum alloy composition, the improvement comprising employing a free machining AA6000 series aluminum alloy having bismuth as a sole free machining constituent, the amount of bismuth between about 0.1 and 1.7% by weight.

8. A machined article made by the method of claim 7.

9. A method of improving the mechanical properties of free machining alloys using an aluminum alloy as a base alloy comprising the steps of:

a) providing a molten AA6000 series aluminum alloy;

b) adjusting the composition of the molten aluminum alloy by adding an effective amount of only bismuth so that the bismuth occupies between about 0.1% and 1.7% by weight of the alloy; and c) solidifying the product of step (b) so that the product is capable of being machined into a machined article.

10. The method of claim 9, wherein the AA6000 series aluminum alloy is an AA6061 alloy.

11. The method of claim 9, wherein when bismuth weight percent ranges between about 0.2% and 1.5%.

12. The method of claim 9, wherein the solidified alloy is processed into a workpiece and machined.

13. In a free machining aluminum alloy having a free machining constituent as a part thereof, the aluminum alloy being consisting essentially of about 0.70 to 1.3% silicon, up to 0.50% iron, up to 0.10% copper, between about 0.40 and 1.0% manganese, between about 0.50 and 1.2% magnesium, up to 0.20% chromium, up to 0.25% zinc, up to 0.10% titanium, up to 0.20% zirconium, the balance being incidental impurities and aluminum, the improvement comprising employing bismuth and tin as free machining constituents as part of the aluminum alloy, wherein the amount of bismuth ranges between about 0.1 and 1.5% by weight and the amount of tin ranges between about 0.1 and 1.5% by weight.

14. In a free machining aluminum alloy having a free machining constituent as a part thereof, the aluminum alloy being consisting essentially of about 1.0 to 1.7% silicon, up to 0.50% iron, 0.15% to 0.40% copper, between about 0.40 and 1.0% manganese, between about 0.50 and 1.2% magnesium, up to 0.10% chromium, up to 0.25% zinc, up to 0.15% titanium, up to 0.20% zirconium, the balance being incidental impurities and aluminum, the improvement comprising employing bismuth and tin as free machining constituents as part of the aluminum alloy, wherein the amount of bismuth ranges between about 0.1 and 1.5% by weight and the amount of tin ranges between about 0.1 and 1.5% by weight.

* * * * *